US010386784B2

(12) United States Patent
Wakamatsu et al.

(10) Patent No.: US 10,386,784 B2
(45) Date of Patent: Aug. 20, 2019

(54) IMAGE FORMING APPARATUS INCLUDING HANDLE COVER CONFIGURED TO COVER HANDLE OF DRUM CARTRIDGE

(71) Applicant: Brother Kogyo Kabushiki Kaisha, Nagoya-shi, Aichi-ken (JP)

(72) Inventors: Mayu Wakamatsu, Inazawa (JP); Masatoshi Shiraki, Nagoya (JP); Kei Katagiri, Nagoya (JP); Shota Iriyama, Toyokawa (JP); Keigo Nakajima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/034,769

(22) Filed: Jul. 13, 2018

(65) Prior Publication Data

US 2019/0025755 A1 Jan. 24, 2019

(30) Foreign Application Priority Data

Jul. 24, 2017 (JP) ..... 2017-143022

(51) Int. Cl.
*G03G 21/16* (2006.01)
*G03G 15/00* (2006.01)
(Continued)

(52) U.S. Cl.
CPC ..... *G03G 21/1676* (2013.01); *G03G 21/1832* (2013.01); *G03G 15/0875* (2013.01)

(58) Field of Classification Search
CPC ..... G03G 15/0875; G03G 21/16; G03G 21/1642; G03G 21/1671; G03G 21/1676;
(Continued)

(56) References Cited

U.S. PATENT DOCUMENTS 5,845,176 A * 12/1998 Yoshida ..... G03G 21/1832 399/113
6,088,555 A * 7/2000 Mizuno ..... G03G 21/1676 399/111
(Continued)

FOREIGN PATENT DOCUMENTS

JP 2006-003690 A 1/2006
JP 2006-184528 A 7/2006
JP 2017-058517 A 3/2017

*Primary Examiner* — Sophia S Chen
(74) *Attorney, Agent, or Firm* — Banner & Witcoff, Ltd.

(57) ABSTRACT

An apparatus main body includes a drum guide configured to guide installation of a drum cartridge into the apparatus main body and a developing guide configured to guide installation of a developing cartridge into the apparatus main body. A downstream end of the developing guide is located farther away from an opening than a downstream end of the drum guide is. The drum cartridge includes a first handle located inside the apparatus main body in a state where the drum cartridge is installed in the apparatus main body. The developing cartridge includes a second handle located inside the apparatus main body in a state where the developing cartridge is installed in the apparatus main body. The handle cover is located between the opening and the first handle to cover the first handle, in a state where the drum cartridge and the developing cartridge are installed in the apparatus main body.

11 Claims, 17 Drawing Sheets

(51) Int. Cl.
*G03G 21/18* (2006.01)
*G03G 15/08* (2006.01)

(58) Field of Classification Search
CPC ..... G03G 21/1817; G03G 21/1821; G03G 21/1832; G03G 21/1842; G03G 21/1846; G03G 2221/1606; G03G 2221/1609; G03G 2221/163; G03G 2221/1853
See application file for complete search history.

(56) References Cited

U.S. PATENT DOCUMENTS

| | | | | |
|---|---|---|---|---|
| 6,163,666 | A * | 12/2000 | Hosokawa ..... | G03G 21/1821 399/111 |
| 2015/0261179 | A1* | 9/2015 | Sato ..... | G03G 21/1842 399/111 |
| 2015/0277362 | A1* | 10/2015 | Yokoi ..... | G03G 21/1676 399/119 |
| 2015/0277368 | A1* | 10/2015 | Nishiyama ..... | G03G 15/0865 399/111 |
| 2017/0075292 | A1 | 3/2017 | Nagae et al. | |
| 2019/0011870 | A1* | 1/2019 | Sato ..... | G03G 21/1671 |

* cited by examiner

IMAGE FORMING APPARATUS INCLUDING HANDLE COVER CONFIGURED TO COVER HANDLE OF DRUM CARTRIDGE

CROSS REFERENCE TO RELATED APPLICATIONS

This application claims priority from Japanese Patent Application No. 2017-143022 filed Jul. 24, 2017. The entire content of the priority application is incorporated herein by reference.

TECHNICAL FIELD

This disclosure relates to an image forming apparatus.

BACKGROUND

An image forming apparatus including an apparatus main body, a drum cartridge, and a developing cartridge is conventionally known.

The apparatus main body has an opening. The drum cartridge is configured to be installed into the apparatus main body through the opening. The drum cartridge includes a photosensitive drum. The developing cartridge is configured to be installed into the apparatus main body through the opening, independently from the drum cartridge. The developing cartridge includes a developing roller.

SUMMARY

According to one aspect, this specification discloses an image forming apparatus. The image forming apparatus includes: an apparatus main body formed with an opening, the apparatus main body including a cover configured to move between an open position at which the opening is opened and a closed position at which the opening is closed; a drum cartridge including a photosensitive drum and configured to be installed into the apparatus main body; a developing cartridge including a developing roller, the developing cartridge being configured to be installed into the apparatus main body independently from the drum cartridge; and a handle cover provided at the developing cartridge. The apparatus main body includes: a drum guide configured to guide installation of the drum cartridge into the apparatus main body, the drum guide extending in an installation direction of the drum cartridge, the drum guide having a first upstream end and a first downstream end in the installation direction of the drum cartridge; and a developing guide configured to guide installation of the developing cartridge into the apparatus main body, the developing guide extending in an installation direction of the developing cartridge, the developing guide having a second upstream end and a second downstream end in the installation direction of the developing cartridge, the second downstream end being located farther away from the opening than the first downstream end is. The drum cartridge includes a first handle located inside the apparatus main body in a state where the drum cartridge is installed in the apparatus main body. The developing cartridge includes a second handle located inside the apparatus main body in a state where the developing cartridge is installed in the apparatus main body. The handle cover is located between the opening and the first handle so as to cover the first handle, in a state where the drum cartridge and the developing cartridge are installed in the apparatus main body.

According to another aspect, this specification also discloses an image forming apparatus. The image forming apparatus includes: an apparatus main body formed with an opening, the apparatus main body including a cover configured to move between an open position at which the opening is opened and a closed position at which the opening is closed; a drum cartridge including a photosensitive drum and configured to be installed into the apparatus main body; a developing cartridge including a developing roller, the developing cartridge being configured to be installed into the apparatus main body independently from the drum cartridge; and a handle cover provided at the apparatus main body. The apparatus main body includes: a drum guide configured to guide installation of the drum cartridge into the apparatus main body, the drum guide extending in an installation direction of the drum cartridge, the drum guide having a first upstream end and a first downstream end in the installation direction of the drum cartridge; and a developing guide configured to guide installation of the developing cartridge into the apparatus main body, the developing guide extending in an installation direction of the developing cartridge, the developing guide having a second upstream end and a second downstream end in the installation direction of the developing cartridge, the second downstream end being located farther away from the opening than the first downstream end is. The drum cartridge includes a first handle located inside the apparatus main body in a state where the drum cartridge is installed in the apparatus main body. The developing cartridge includes a second handle located inside the apparatus main body in a state where the developing cartridge is installed in the apparatus main body. The handle cover is located between the opening and the first handle so as to cover the first handle, in a state where the drum cartridge and the developing cartridge are installed in the apparatus main body.

According to still another aspect, this specification also discloses an image forming apparatus. The image forming apparatus includes: an apparatus main body formed with an opening, the apparatus main body including a cover configured to move between an open position at which the opening is opened and a closed position at which the opening is closed; a drum cartridge including a photosensitive drum and configured to be installed into the apparatus main body; a developing cartridge including a developing roller, the developing cartridge being configured to be installed into the apparatus main body independently from the drum cartridge; and a handle cover provided at the drum cartridge. The apparatus main body includes: a drum guide configured to guide installation of the drum cartridge into the apparatus main body, the drum guide extending in an installation direction of the drum cartridge, the drum guide having a first upstream end and a first downstream end in the installation direction of the drum cartridge; and a developing guide configured to guide installation of the developing cartridge into the apparatus main body, the developing guide extending in an installation direction of the developing cartridge, the developing guide having a second upstream end and a second downstream end in the installation direction of the developing cartridge, the second downstream end being located farther away from the opening than the first downstream end is. The drum cartridge includes a first handle located inside the apparatus main body in a state where the drum cartridge is installed in the apparatus main body. The developing cartridge includes a second handle located inside the apparatus main body in a state where the developing cartridge is installed in the apparatus main body. The handle cover is located between the opening and the first handle so as to cover the first handle, in a state where the drum cartridge and the developing cartridge are installed in the apparatus main body.

BRIEF DESCRIPTION OF THE DRAWINGS

Embodiments in accordance with this disclosure will be described in detail with reference to the following figures wherein.

DETAILED DESCRIPTION

In the above-mentioned image forming apparatus, in a state where the drum cartridge and the developing cartridge are installed in the apparatus main body, a user sees both the drum cartridge and the developing cartridge through the opening.

Hence, when the user wishes to preferentially remove the developing cartridge which requires a replacement more frequently, the user may try to erroneously remove the drum cartridge from the apparatus main body.

An example of an object of this disclosure is to provide an image forming apparatus that, in a state where a drum cartridge and a developing cartridge are installed in an apparatus main body, the developing cartridge can be selected and removed reliably.

1. Overview of Image Forming Apparatus 1

The overview of an image forming apparatus 1 will be described.

Figure 1:
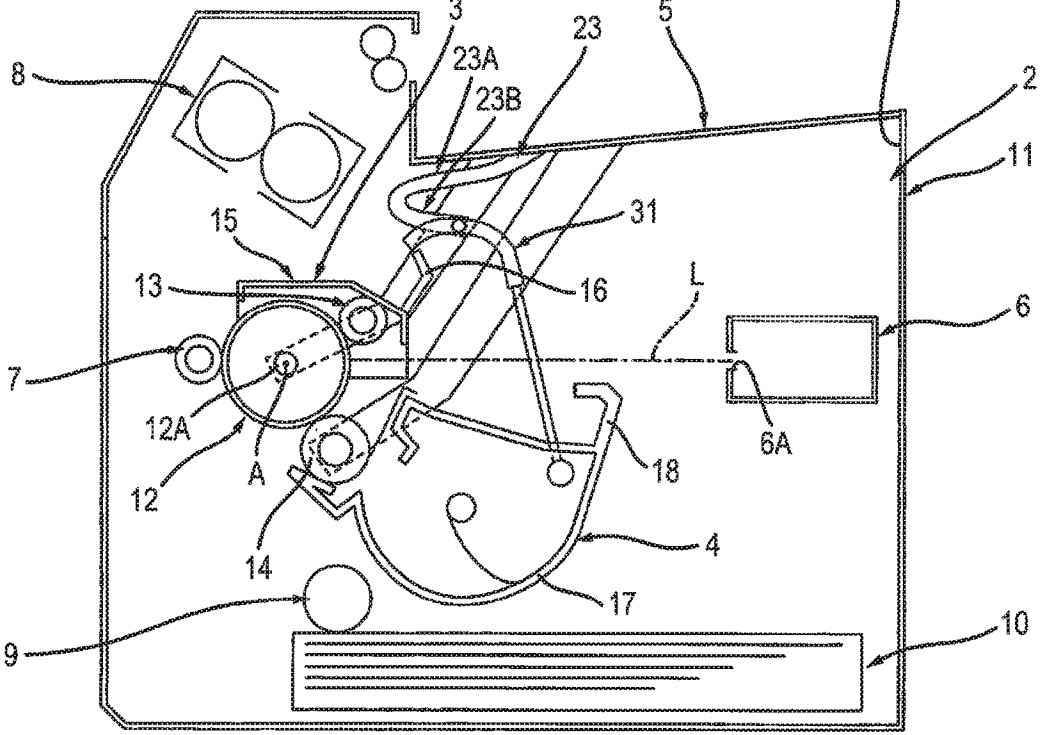
FIG. 1 is a schematic diagram showing the configuration of an image forming apparatus according to a first embodiment.

As shown in FIG. 1, the image forming apparatus 1 includes an apparatus main body 2, a drum cartridge 3, and a developing cartridge 4.

1.1 Apparatus Main Body 2

The apparatus main body 2 is formed with an opening 2A for installing the drum cartridge 3 and the developing cartridge 4 into the apparatus main body 2. The opening 2A is commonly used both when the drum cartridge 3 is installed into the apparatus main body 2 and when the developing cartridge 4 is installed into the apparatus main body 2. The apparatus main body 2 includes a main casing 11, a cover 5, an exposing device 6, a transfer roller 7, a fixing device 8, a paper feeder 9, and a paper feed tray 10.

The main casing 11 constitutes the exterior of the apparatus main body 2. The main casing 11 accommodates the exposing device 6, the transfer roller 7, the fixing device 8, the paper feeder 9, and the paper feed tray 10. In a state where the drum cartridge 3 and the developing cartridge 4 are installed in the apparatus main body 2, the main casing 11 accommodates the drum cartridge 3 and the developing cartridge 4. The main casing 11 has a box shape.

The cover 5 is configured to move between an open position at which the opening 2A is opened (see FIG. 4) and a closed position at which the opening 2A is closed (see FIG. 1).

The exposing device 6 exposes a photosensitive drum 12. The photosensitive drum 12 will be described later. Specifically, the exposing device 6 is configured to expose a circumferential surface of the photosensitive drum 12. The exposing device 6 is configured to emit light L. For example, the exposing device 6 is a laser scan unit. The exposing device 6 has an emission opening 6A for emitting light L. The light L emitted from the emission opening 6A passes between a handle cover 31 and a developing frame 17, and is incident on the circumferential surface of the photosensitive drum 12. The handle cover 31 and the developing frame 17 will be described later.

The transfer roller 7 is configured to transfer, onto paper, a toner image formed on the circumferential surface of the photosensitive drum 12. The transfer roller 7 contacts the circumferential surface of the photosensitive drum 12 when the drum cartridge 3 is installed in the apparatus main body 2.

The fixing device 8 is configured to heat and apply pressure to paper on which a toner image is transferred, thereby fixing the toner image on the paper. The paper having passed the fixing device 8 is discharged onto the cover 5.

The paper feeder 9 is configured to supply paper in the paper feed tray 10 to between the photosensitive drum 12 and the transfer roller 7.

The paper feed tray 10 is configured to accommodate paper.

1.2 Drum Cartridge 3

The drum cartridge 3 is configured to be installed into the apparatus main body 2 through the opening 2A. The drum cartridge 3 includes the photosensitive drum 12, a charging roller 13, a drum frame 15, and a first handle 16.

The photosensitive drum 12 is configured to rotate about a rotational axis A extending in an axial direction. The photosensitive drum 12 includes a drum shaft 12A extending along the rotational axis A.

The charging roller 13 is configured to charge the circumferential surface of the photosensitive drum 12. The charging roller 13 contacts the circumferential surface of the photosensitive drum 12.

The drum frame 15 supports the photosensitive drum 12 and the charging roller 13. The drum frame 15 extends in the axial direction.

The first handle 16 is configured to be gripped by a user when the drum cartridge 3 is installed into the apparatus main body 2 or when the drum cartridge 3 is removed from the apparatus main body 2. The first handle 16 is located inside the apparatus main body 2 in a state where the drum cartridge 3 is installed in the apparatus main body 2. The first handle 16 extends from the drum frame 15.

1.3 Developing Cartridge 4

The developing cartridge 4 is configured to be installed into the apparatus main body 2 through the opening 2A. The developing cartridge 4 is configured to be installed into the apparatus main body 2 independently from the drum cartridge 3. The developing cartridge 4 includes a developing roller 14, the developing frame 17, and a second handle 18.

The developing roller 14 is configured to supply toner to the photosensitive drum 12. The developing roller 14 contacts the circumferential surface of the photosensitive drum 12 when the drum cartridge 3 and the developing cartridge 4 are installed in the apparatus main body 2. The developing roller 14 includes a shaft 14A extending in the axial direction.

The developing frame 17 accommodates toner. The developing frame 17 supports the developing roller 14. The developing frame 17 extends in the axial direction. The developing frame 17 has one end 17A (see FIG. 3) and an other end 17B (see FIG. 3) in the axial direction. The developing frame 17 has a cylindrical shape.

The second handle 18 is configured to be gripped by the user when the developing cartridge 4 is installed into the apparatus main body 2 or when the developing cartridge 4 is removed from the apparatus main body 2. The second handle 18 is located inside the apparatus main body 2 in a state where the developing cartridge 4 is installed in the apparatus main body 2. The second handle 18 extends from the developing frame 17.

2. Detail of Image Forming Apparatus 1

The detail of the image forming apparatus 1 will be described while referring to FIG. 1 to FIG. 6.

As shown in FIG. 1, the image forming apparatus 1 includes a handle cover 31.

The handle cover 31 is located between the opening 2A and the first handle 16 in a state where the drum cartridge 3 and the developing cartridge 4 are installed in the apparatus main body 2. In other words, the handle cover 31 is located between the first handle 16 and the cover 5 located at the closed position, in a state where the drum cartridge 3 and the developing cartridge 4 are installed in the apparatus main body 2. The phrase "the handle cover 31 is located between the first handle 16 and the cover 5 located at the closed position" means that the handle cover 31 intersects one of straight lines connecting the first handle 16 with the cover 5 located at the closed position in a central cross-sectional view of the image forming apparatus 1 as viewed from the axial direction as shown in FIG. 1. The handle cover 31 covers the first handle 16. Specifically, the handle cover 31 covers an entirety of the first handle 16. The phrase "the handle cover 31 covers an entirety of the first handle 16" means that the handle cover 31 covers an entirety of the first handle 16 such that, when a user looks inside the apparatus main body 2 through the opening 2A in a state where the drum cartridge 3 and the developing cartridge 4 are installed in the apparatus main body 2, the user cannot see the first handle 16.

In the first embodiment, the handle cover 31 is provided at the developing cartridge 4. The detail of the developing cartridge 4 and the apparatus main body 2 will be described below.

2.1 Detail of Developing Cartridge 4

Figure 2B:
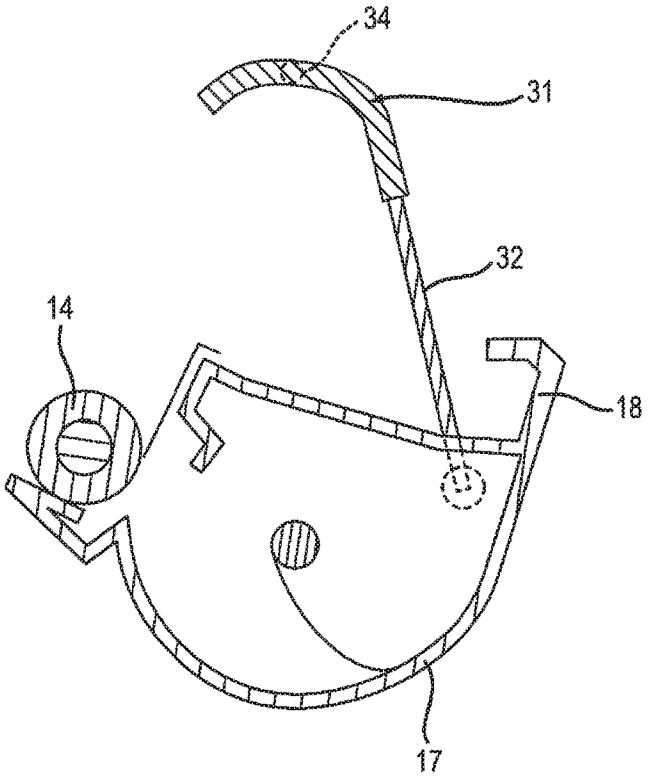
FIG. 2B is a cross-sectional view of the developing cartridge shown in FIG. 1 and shows a state where the handle cover is located at a second position.
Figure 2A:
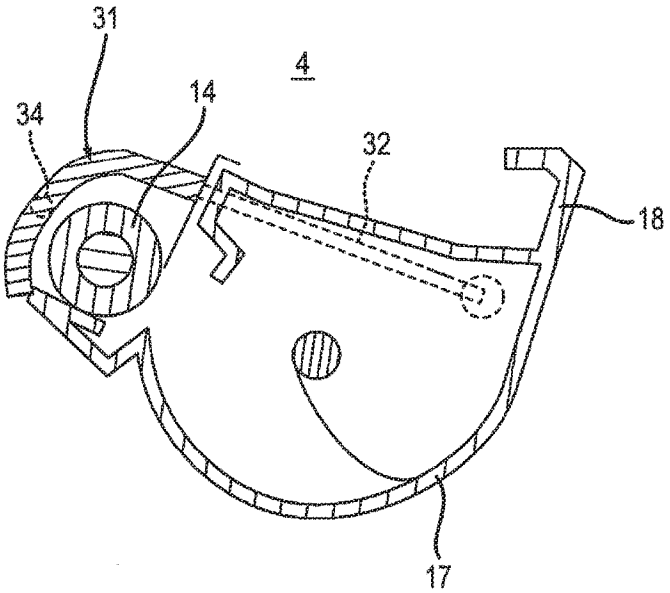
FIG. 2A is a cross-sectional view of the developing cartridge shown in FIG. 1 and shows a state where a handle cover is located at a first position.
Figure 3:
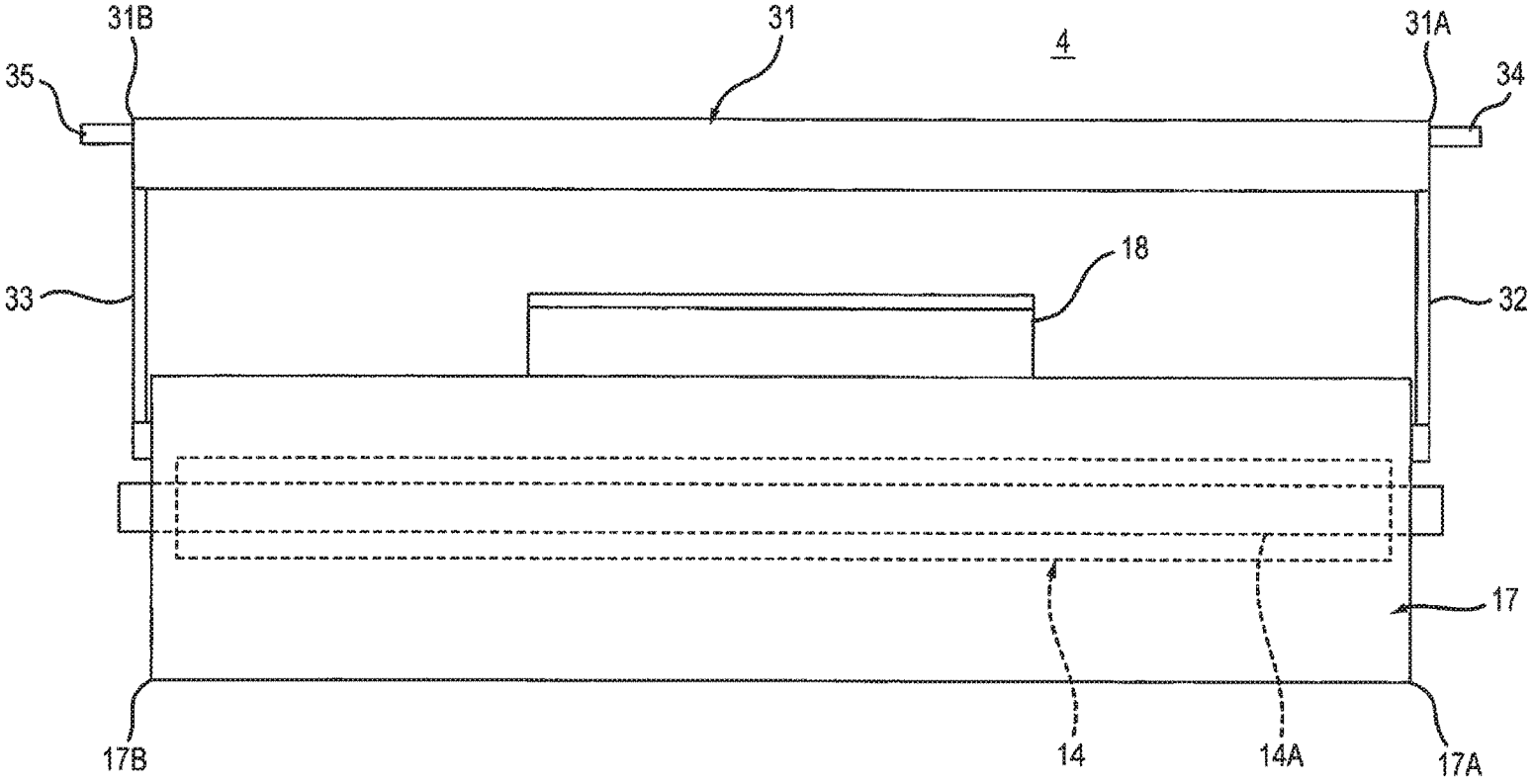
FIG. 3 is a front view of the developing cartridge shown in FIG. 2B.

As shown in FIG. 2A and FIG. 3, the developing cartridge 4 includes the handle cover 31, a first boss 34, a second boss 35 (see FIG. 3), a first arm 32, and a second arm 33 (see FIG. 3).

2.1.1 Handle Cover 31

As shown in FIG. 1, the handle cover 31 covers the first handle 16 in a state where the developing cartridge 4 is installed in the apparatus main body 2. The handle cover 31 is spaced from the first handle 16 in a state where the handle cover 31 covers the first handle 16. As shown in FIG. 2A, the handle cover 31 covers the developing roller 14 in a state where the developing cartridge 4 is removed from the apparatus main body 2. Specifically, as shown in FIG. 2A and FIG. 2B, the handle cover 31 is configured to move relative to the developing roller 14 between a first position at which the developing roller 14 is covered (see FIG. 2A) and a second position at which the developing roller 14 is exposed (see FIG. 2B). The handle cover 31 is located at the first position relative to the developing roller 14 in a state where the developing cartridge 4 is removed from the apparatus main body 2. The handle cover 31 is located at the second position relative to the developing roller 14 in a state where the developing cartridge 4 is installed in the apparatus main body 2 (see FIG. 1). In a state where the handle cover 31 is located at the second position, the handle cover 31 is spaced from the developing frame 17 so as not to contact the developing frame 17. That is, the handle cover 31 is spaced from the developing frame 17 in a state where the handle cover 31 covers the first handle 16 (see FIG. 1). This configuration allows light L emitted from the exposing device 6 (see FIG. 1) to pass through an interval between the handle cover 31 and the developing frame 17. In a state where the handle cover 31 is located at the first position, the handle cover 31 extends along the circumferential surface of the developing roller 14. As shown in FIG. 3, the handle cover 31 extends in the axial direction. The handle cover 31 has one end 31A and an other end 31B in the axial direction.

2.1.2 First Boss 34 and Second Boss 35

The first boss 34 is located at the one end 31A of the handle cover 31. The first boss 34 extends (protrudes) in the axial direction. The first boss 34 has a columnar shape. The first boss 34 is fitted in a handle guide 23 (see FIG. 4) of the apparatus main body 2. The handle guide 23 will be described later.

The second boss 35 is located at the other end 31B of the handle cover 31. The second boss 35 extends in the axial direction. The second boss 35 has a columnar shape. The second boss 35 is fitted in a second handle guide of the apparatus main body 2. The second handle guide will be described later.

2.1.3 First Arm 32 and Second Arm 33

The first arm 32 is coupled to the developing frame 17 and the handle cover 31. Specifically, the first arm 32 extends in a direction intersecting the axial direction. Preferably, the first arm 32 extends in a direction perpendicular to the axial direction. One end of the first arm 32 is coupled to the one end 31A of the handle cover 31. The other end of the first arm 32 is rotatably coupled to the one end 17A of the developing frame 17.

The second arm 33 is spaced from the first arm 32 in the axial direction. With this configuration, the light L emitted from the exposing device 6 (see FIG. 1) passes between the first arm 32 and the second arm 33 in the axial direction. The second arm 33 is coupled to the developing frame 17 and the handle cover 31. Specifically, the second arm 33 extends in a direction intersecting the axial direction. In other words, the second arm 33 extends in the same direction as the direction in which the first arm 32 extends. Preferably, the second arm 33 extends in a direction perpendicular to the axial direction. One end of the second arm 33 is coupled to the other end 31B of the handle cover 31. The other end of the second arm 33 is rotatably coupled to the other end 17B of the developing frame 17.

2.2 Detail of Apparatus Main Body 2

Figure 4:
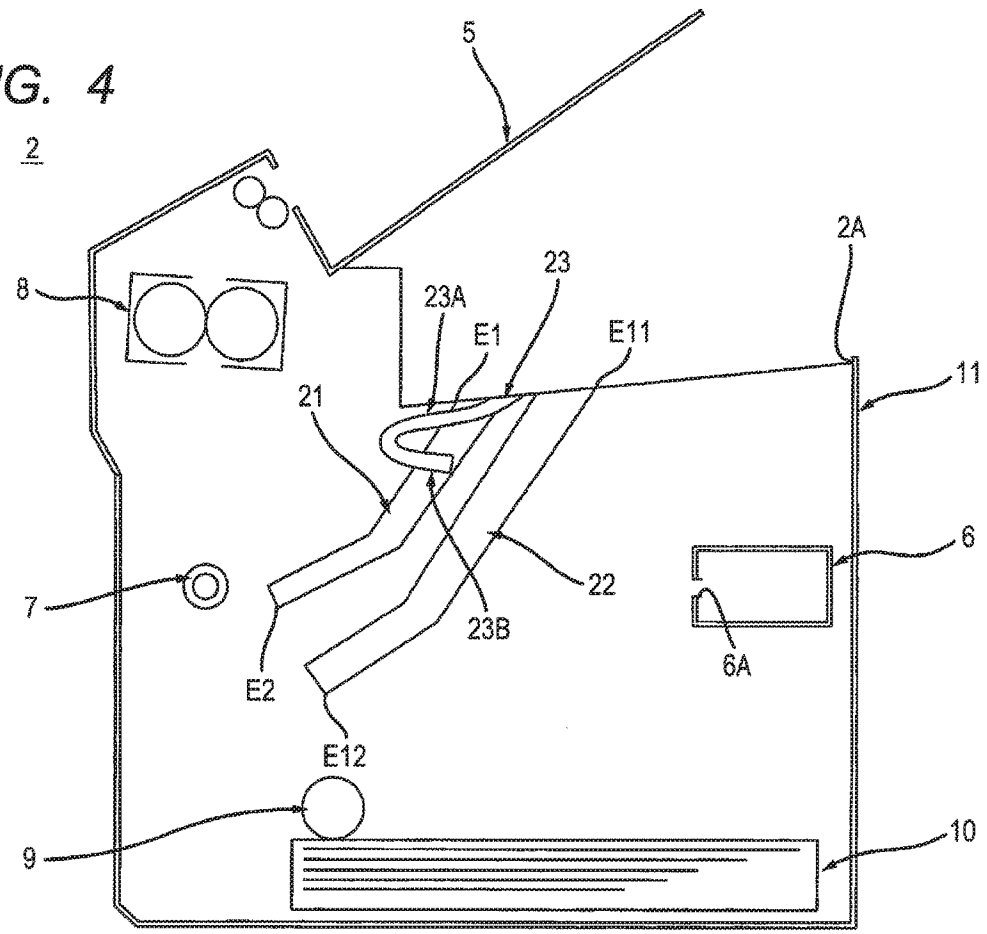
FIG. 4 shows an apparatus main body shown in FIG. 1.

As shown in FIG. 4, the apparatus main body 2 includes a drum guide 21, a second drum guide, a developing guide 22, a second developing guide, the handle guide 23, and the second handle guide. The second drum guide, the second developing guide, and the second handle guide are not shown in the drawings.

2.2.1 Drum Guide 21

The drum guide 21 guides installation of the drum cartridge 3 (see FIG. 1) into the apparatus main body 2. Specifically, when the drum cartridge 3 is installed into the apparatus main body 2, the drum guide 21 guides the drum cartridge 3 to the position at which the photosensitive drum 12 (see FIG. 1) contacts the transfer roller 7. The drum shaft 12A (see FIG. 1) is fitted in the drum guide 21. One end of the drum shaft 12A in the axial direction is fitted in the drum guide 21. The drum guide 21 is located on an inner surface of the apparatus main body 2 in the axial direction. The drum guide 21 extends in the installation direction of the drum cartridge 3. The drum guide 21 has a first upstream end E1 and a first downstream end E2 in the installation direction of the drum cartridge 3. In a state where the cover 5 is located at the closed position, the first upstream end E1 is located between the cover 5 and the first downstream end E2 in the installation direction of the drum cartridge 3. The first downstream end E2 is located between the transfer roller 7 and the exposing device 6 in a horizontal direction.

2.2.2 Second Drum Guide

The second drum guide, together with the drum guide 21, guides installation of the drum cartridge 3 into the apparatus main body 2. In a state where the drum cartridge 3 is installed in the apparatus main body 2, the second drum guide is located at the opposite side from the drum guide 21 with respect to the drum cartridge 3 in the axial direction. The other end of the drum shaft 12A in the axial direction is fitted in the second drum guide. The second drum guide has the same shape as the drum guide 21.

2.2.3 Developing Guide 22

The developing guide 22 guides installation of the developing cartridge 4 (see FIG. 1) into the apparatus main body 2. When the developing cartridge 4 is installed into the apparatus main body 2, the developing guide 22 guides the developing cartridge 4 to the position at which the developing roller 14 (see FIG. 1) contacts the photosensitive drum 12. The shaft 14A of the developing roller 14 (see FIG. 3) is fitted in the developing guide 22. One end of the shaft 14A of the developing roller 14 in the axial direction is fitted in the developing guide 22. The developing guide 22 is located between the drum guide 21 and the exposing device 6. The developing guide 22 is located on the inner surface of the apparatus main body 2 in the axial direction. The developing guide 22 extends in the installation direction of the developing cartridge 4. The developing guide 22 has a second upstream end E11 and a second downstream end E12 in the installation direction of the developing cartridge 4. In a state where the cover 5 is located at the closed position, the second upstream end E11 is located between the cover 5 and the second downstream end E12 in the installation direction of the developing cartridge 4. The second downstream end E12 is located farther away from the opening 2A than the first downstream end E2 is. The second downstream end E12 is located farther away from the cover 5 located at the closed position than the first downstream end E2 is. Specifically, the distance between the cover 5 located at the closed position and the second downstream end E12 in the upper-lower direction is longer than the distance between the cover 5 located at the closed position and the first downstream end E2 in the upper-lower direction. That is, the second downstream end E12 is located at a lower position than the first downstream end E2 of the drum guide 21. With this configuration, as shown in FIG. 1, in a state where the drum cartridge 3 and the developing cartridge 4 are installed in the apparatus main body 2, the developing cartridge 4 is located at a lower position than the first handle 16 of the drum cartridge 3. In other words, in a state where the drum cartridge 3 and the developing cartridge 4 are installed in the apparatus main body 2, the developing cartridge 4 is located farther away from the cover 5 located at the closed position than the first handle 16 is.

Hence, in a case where no handle cover 31 is provided, when the user looks inside the apparatus main body 2 through the opening 2A in a state where the drum cartridge 3 are the developing cartridge 4 are installed in the apparatus main body 2, the user can see both the first handle 16 of the drum cartridge 3 and the second handle 18 of the developing cartridge 4. Hence, in a case where no handle cover 31 is provided, when the user wishes to preferentially remove the developing cartridge 4, the user may try to erroneously remove the drum cartridge 3 from the apparatus main body 2.

2.2.4 Second Developing Guide

The second developing guide, together with the developing guide 22, guides installation of the developing cartridge 4 into the apparatus main body 2. In a state where the developing cartridge 4 is installed in the apparatus main body 2, the second developing guide is located at the opposite side from the developing guide 22 with respect to the developing cartridge 4 in the axial direction. The other end of the shaft 14A of the developing roller 14 in the axial direction is fitted in the second developing guide. The second developing guide has the same shape as the developing guide 22.

2.2.5 Handle Guide 23

As shown in FIG. 4, when the developing cartridge 4 is installed into the apparatus main body 2, the handle guide 23 causes the handle cover 31 to move from the first position (see FIG. 5) toward the second position (see FIG. 1). The first boss 34 (see FIG. 3) is fitted in the handle guide 23. When the developing cartridge 4 is installed into the apparatus main body 2, the handle guide 23 guides the first boss 34, thereby causing the handle cover 31 to move from the first position toward the second position. As shown in FIG. 1, in a state where the drum cartridge 3 is installed in the apparatus main body 2, the handle guide 23 is located between the drum cartridge 3 and the opening 2A. In a state where the drum cartridge 3 is installed in the apparatus main body 2, the handle guide 23 is located between the drum cartridge 3 and the cover 5 located at the closed position. The handle guide 23 has a first part 23A and a second part 23B.

Figure 5:
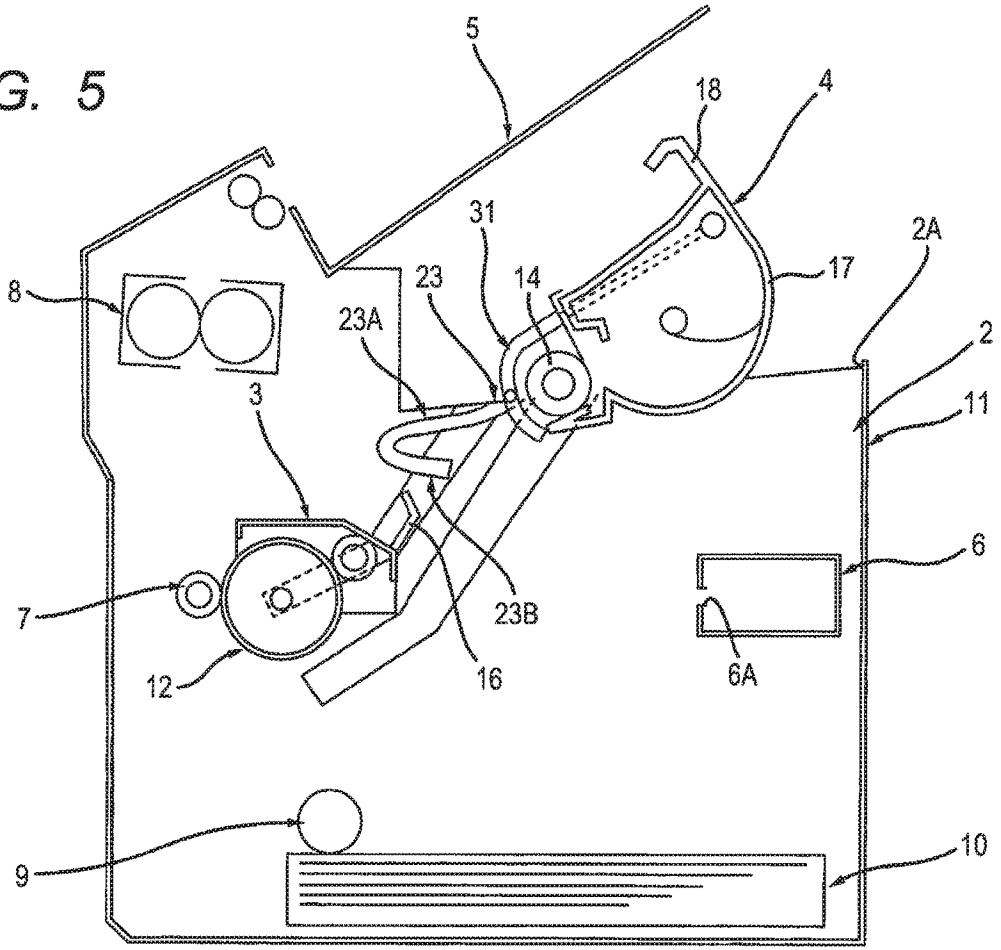
FIG. 5 is an explanatory diagram for explaining an installation operation of the developing cartridge and shows a state where the handle cover is located at the first position.
Figure 6:
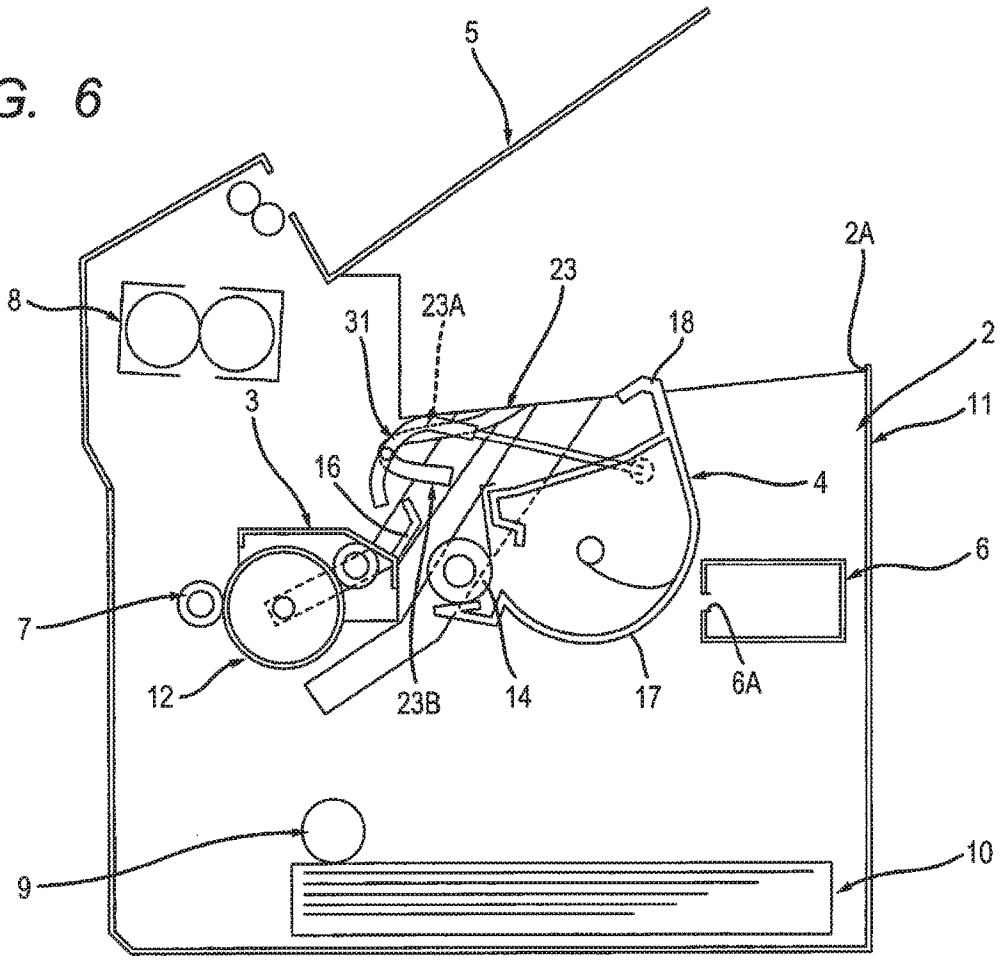
FIG. 6 is another explanatory diagram for illustrating the installation operation of the developing cartridge, continuing from FIG. 5, and shows a transitional state where the handle cover moves from the first position to the second position.

In a state where the drum cartridge 3 is installed in the apparatus main body 2, the first part 23A extends in a direction separating from the developing guide 22 as the first part 23A approaches the drum cartridge 3. With this configuration, as shown in FIG. 5 and FIG. 6, when the developing cartridge 4 is installed into the apparatus main body 2, the handle cover 31 moves, relative to the developing roller 14, in a direction separating from the developing roller 14 as the handle cover 31 approaches the drum cartridge 3. That is, when the developing cartridge 4 is installed into the apparatus main body 2, the handle cover 31 moves from the first position toward the second position by being guided by the first part 23A.

As shown in FIG. 1, the second part 23B is located between the cover 5 located at the closed position and the first handle 16 of the drum cartridge 3. The second part 23B is located between the first part 23A and the first handle 16 of the drum cartridge 3. The second part 23B is continuous with the first part 23A. Here, the first part 23A may be substantially continuous with the second part 23B to an extent that the first boss 34 can be handed over between the first part 23A and the second part 23B. Specifically, the first part 23A and the second part 23B may be separated from each other with a gap (interval) therebetween to an extent that the first boss 34 can be handed over between the first part 23A and the second part 23B. The gap to an extent that the first boss 34 can be handed over is, specifically, a gap smaller than the diameter of the first boss 34. If the first part 23A and the second part 23B are separated from each other with a gap therebetween but the gap between the first part 23A and the second part 23B is smaller than the diameter of the first boss 34, the first boss 34 is handed over from the first part 23A to the second part 23B without falling in between the first part 23A and the second part 23B. Preferably, the first part 23A is continuous with the second part 23B without having a gap therebetween. With this configuration, the first boss 34 is handed over smoothly from the first part 23A to the second part 23B. Note that a member including the first part 23A and the second part 23B is manufactured as one component by injection molding using the same mold. The second part 23B extends in a direction approaching from the drum guide 21 toward the developing guide 22. With this configuration, in a state where the developing cartridge 4 is installed in the apparatus main body 2 and where the handle cover 31 is spaced from the developing roller 14, the handle cover 31 is located between the cover 5 located at the closed position and the first handle 16 of the drum cartridge 3. That is, when the developing cartridge 4 is installed into the apparatus main body 2, the handle cover 31 is guided by the second part 23B, thereby being located at the second position.

2.2.6 Second Handle Guide

When the developing cartridge 4 is installed into the apparatus main body 2, the second handle guide, together with the handle guide 23, causes the handle cover 31 to move from the first position toward the second position. In a state where the developing cartridge 4 is installed in the apparatus main body 2, the second handle guide is located at the opposite side from the handle guide 23 with respect to the handle cover 31 in the axial direction. The second boss 35 (see FIG. 3) is fitted in the second handle guide. The second handle guide has the same shape as the handle guide 23.

3. Operations and Effects

According to the image forming apparatus 1, as shown in FIG. 1, the first handle 16 of the drum cartridge 3 is covered by the handle cover 31 in a state where the drum cartridge 3 and the developing cartridge 4 are installed in the apparatus main body 2.

Hence, when the user looks inside the apparatus main body 2 through the opening 2A, the user cannot see the first handle 16 of the drum cartridge 3.

With this configuration, in a state where the drum cartridge 3 and the developing cartridge 4 are installed in the apparatus main body 2, the user's attention is drawn to the second handle 18 of the developing cartridge 4, not the first handle 16 of the drum cartridge 3.

As a result, in a state where the drum cartridge 3 and the developing cartridge 4 are installed in the apparatus main body 2, the developing cartridge 4 can be reliably selected and removed from the apparatus main body 2.

4. Modification of First Embodiment

A modification of the first embodiment will be described while referring to FIG. 7 to FIG. 10. In FIG. 7 to FIG. 10, parts and components similar to those in the first embodiment are designated by the same reference numerals to avoid duplicating description.

Figure 7:
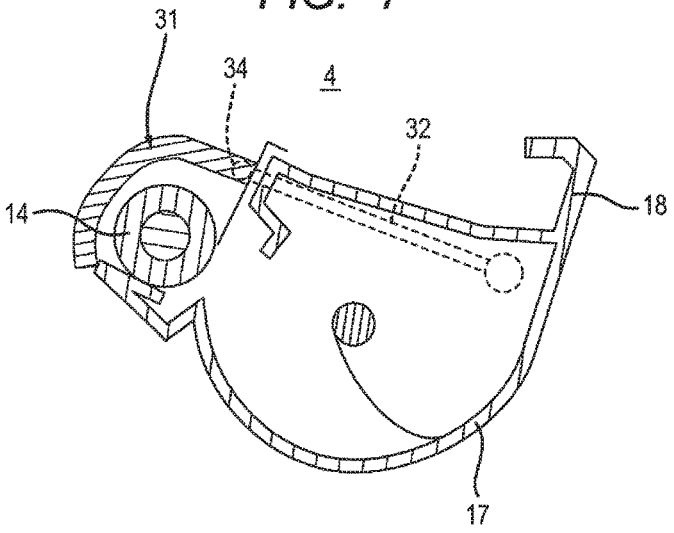
FIG. 7 is an explanatory diagram for illustrating a modification of the first embodiment in which a first boss is located in the neighborhood of a first arm.
Figure 8:
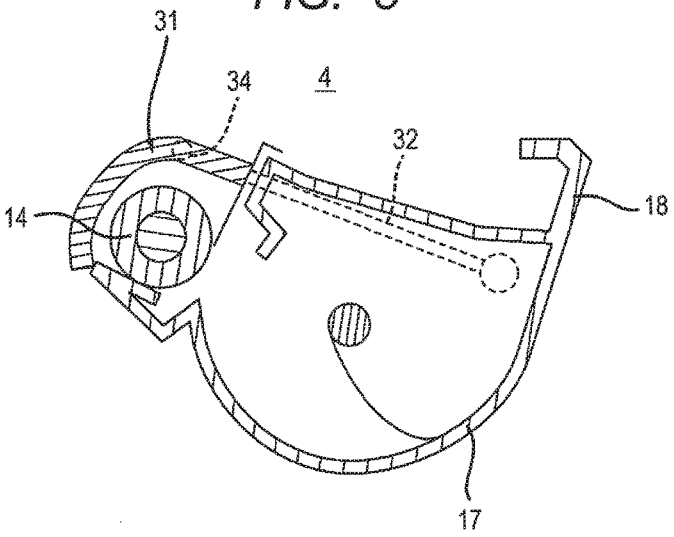
FIG. 8 is an explanatory diagram for illustrating a modification of the first embodiment, which is different from the modification shown in FIG. 7, in which the first boss is located away from the first arm.

The arrangement of the above-described first boss 34 is not limited to a particular embodiment. For example, the first boss 34 may be located near the first arm 32 as shown in FIG. 7, or may be located away from the first arm 32 as shown in FIG. 8. The arrangement of the above-described second boss 35 is also not limited to a particular embodiment.

Figure 9:
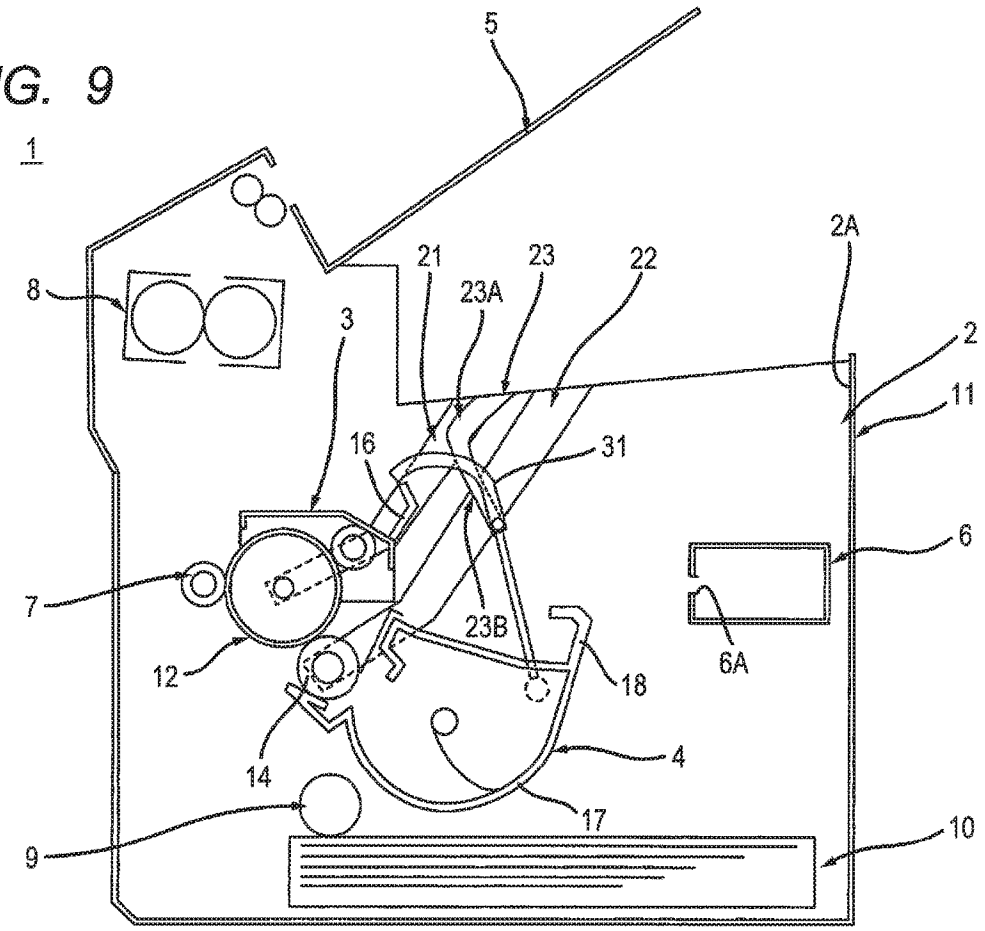
FIG. 9 is an explanatory diagram for illustrating a handle guide of the modification shown in FIG. 7.
Figure 10:
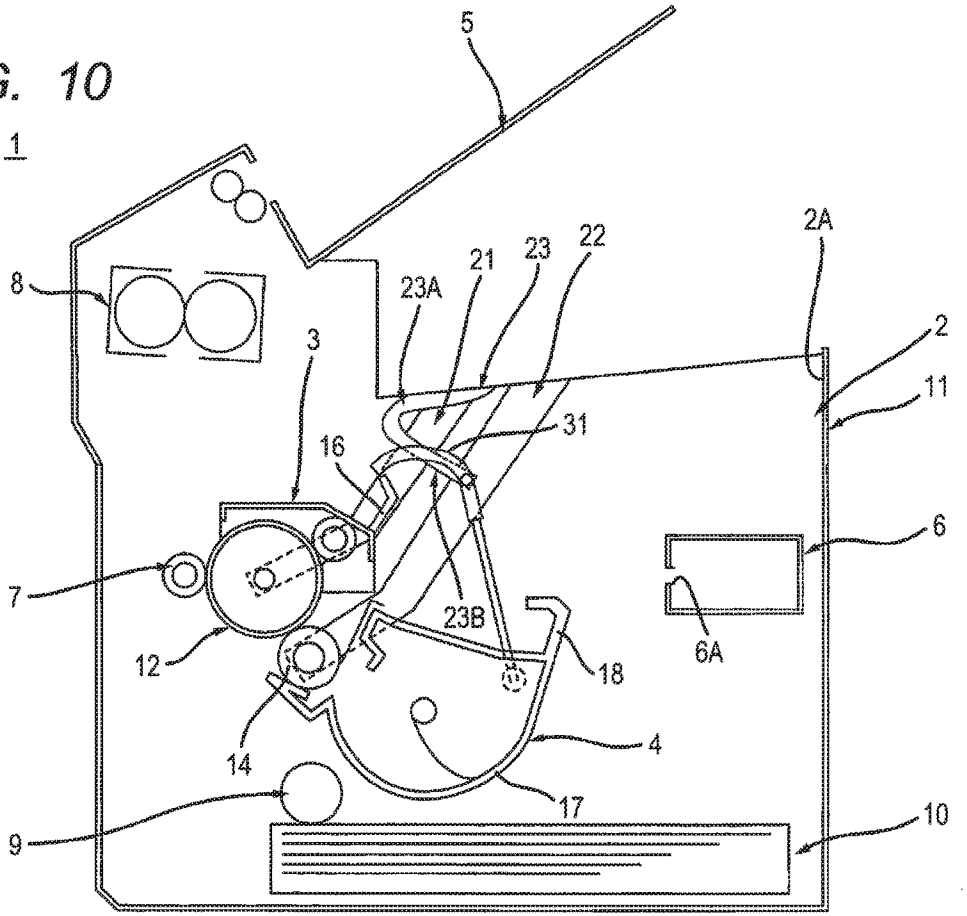
FIG. 10 is an explanatory diagram for illustrating a handle guide of the modification shown in FIG. 8.

The shape of the above-described handle guide 23 may be changed appropriately depending on the arrangement of the first boss 34. For example, in a case where the first boss 34 is located near the first arm 32, as shown in FIG. 9, the second part 23B may intersect the developing guide 22. In a case where the first boss 34 is located away from the first arm 32, as shown in FIG. 10, the end of the second part 23B may be located in the developing guide 22.

In these modifications, operations and effects similar to those of the first embodiment are obtained.

5. Second Embodiment

A second embodiment will be described below while referring to FIG. 11 and FIG. 12. In the second embodiment, parts and components similar to those in the first embodiment are designated by the same reference numerals to avoid duplicating description.

Figure 11:
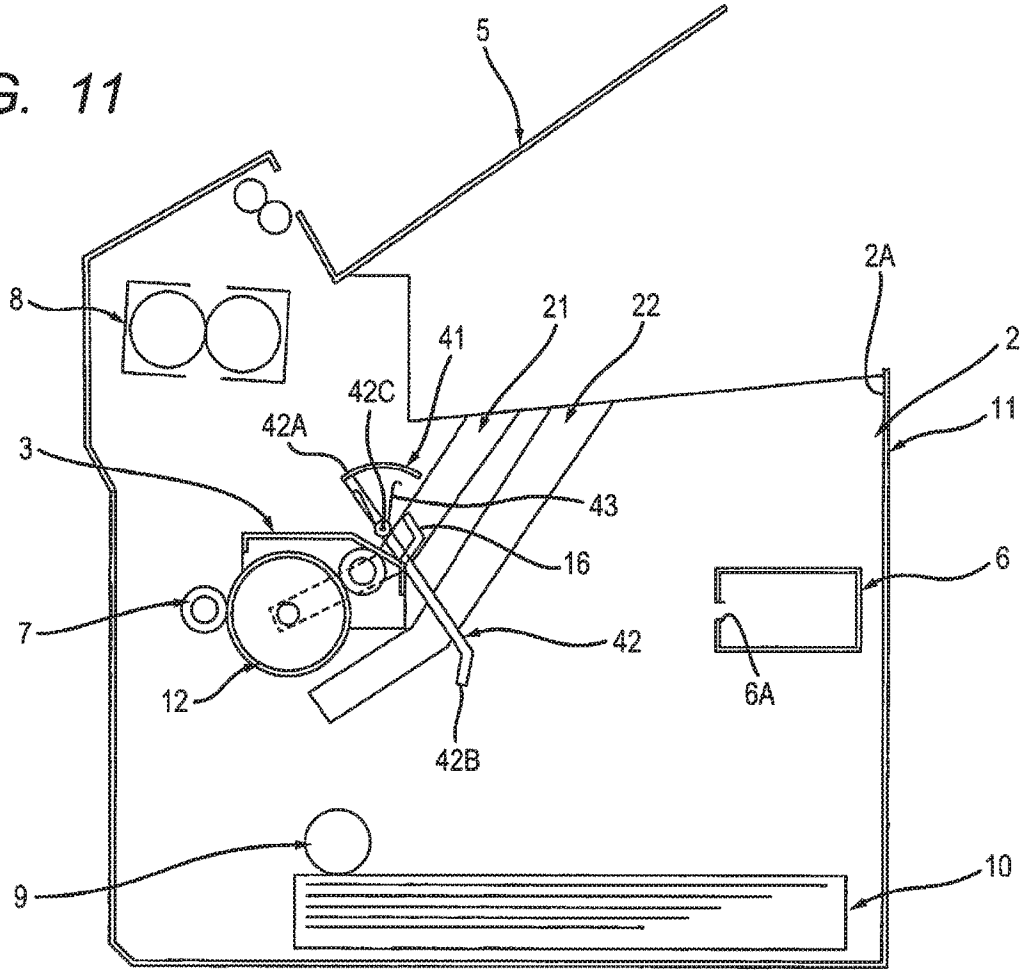
FIG. 11 is an explanatory diagram for illustrating an image forming apparatus according to a second embodiment, and shows a state where a developing cartridge is removed from an apparatus main body and where a handle cover exposes a first handle.

As shown in FIG. 11, in the second embodiment, a handle cover 41 is provided at the apparatus main body 2.

In this case, the apparatus main body 2 further includes an arm 42.

The arm 42 supports the handle cover 41. The handle cover 41 may be a separate component from the arm 42 and be attached to the arm 42. In this case, the arm 42 supports the attached handle cover 41. Alternatively, the handle cover 41 and the arm 42 may be formed as one component by a method of injection molding and so on. In this case, the part of the arm 42 out of the molded one part supports the part of the handle cover 41. The arm 42 is configured to rotatably move relative to the apparatus main body 2. When the developing cartridge 4 is installed in the apparatus main body 2, the arm 42 contacts the developing cartridge 4 and is rotated. Specifically, the arm 42 is attached to the inner surface of the apparatus main body 2 in the axial direction. In a state where the drum cartridge 3 is installed in the apparatus main body 2, the arm 42 is located between the drum cartridge 3 and the inner surface of the apparatus main body 2, in the axial direction. The arm 42 extends in a direction intersecting the axial direction. Preferably, the arm 42 extends in a direction perpendicular to the axial direction. The arm 42 has one end 42A and an other end 42B in the direction in which the arm 42 extend. A rotational axis 42C of the arm 42 is located between the one end 42A and the other end 42B in the direction in which the arm 42 extends.

In the second embodiment, the handle cover 41 moves between a first position at which the first handle 16 is exposed (see FIG. 11) and a second position at which the first handle 16 is covered (see FIG. 12) due to rotational movement of the arm 42. The handle cover 41 is located at the first position in a state where the developing cartridge 4 is removed from the apparatus main body 2.

Figure 12:
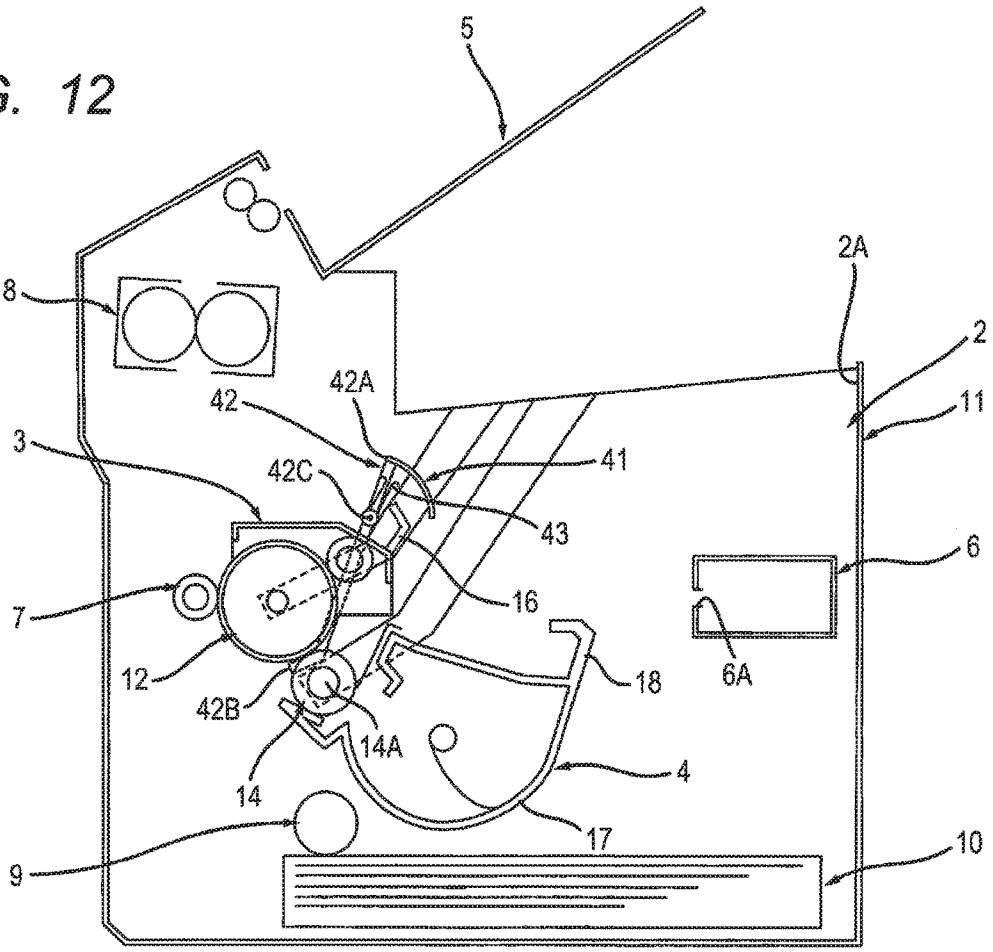
FIG. 12 is an explanatory diagram for illustrating the image forming apparatus according to the second embodiment, together with FIG. 11, and shows a state where the developing cartridge is installed in the apparatus main body and where the handle cover covers the first handle.

As shown in FIG. 12, when the developing cartridge 4 is installed into the apparatus main body 2 in a state where the drum cartridge 3 is installed in the apparatus main body 2, the developing cartridge 4 contacts the other end 42B of the arm 42. Specifically, when the developing cartridge 4 is installed into the apparatus main body 2, the shaft 14A of the developing roller 14 contacts the other end 42B of the arm 42. With this configuration, the handle cover 41 moves from the first position to the second position.

The handle cover 41 located at the second position is pressed by a pressing member 43 toward the first position. With this configuration, when the developing cartridge 4 is removed from the apparatus main body 2, the handle cover 41 moves from the second position to the first position. The pressing member 43 is a torsion spring, for example.

In the second embodiment, operations and effects similar to those of the first embodiment are obtained.

6. Third Embodiment

A third embodiment will be described below while referring to FIG. 13 to FIG. 15. In the third embodiment, parts and components similar to those in the first embodiment are designated by the same reference numerals to avoid duplicating description.

Figure 13:
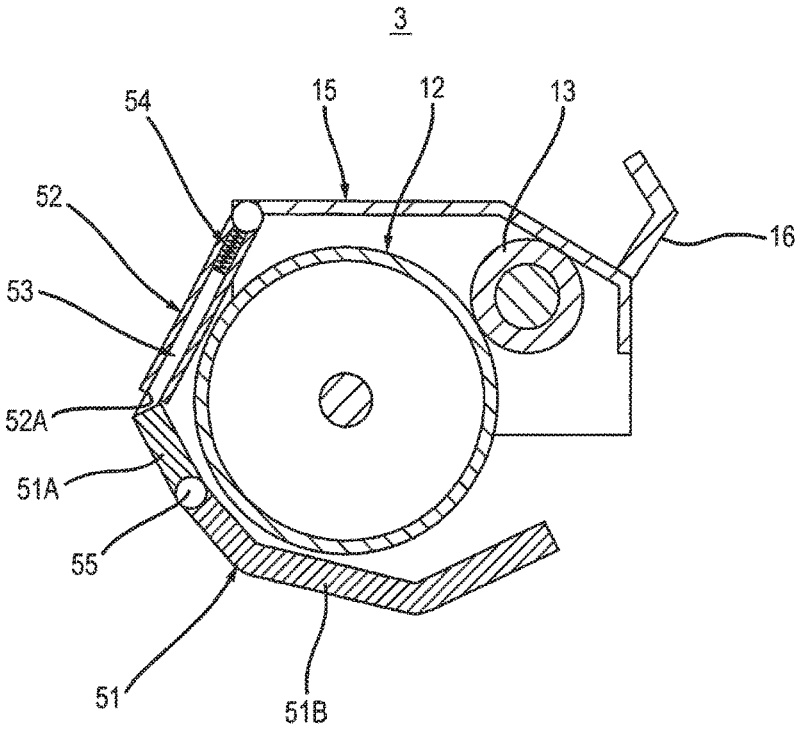
FIG. 13 is a cross-sectional view showing a drum cartridge according to a third embodiment, and shows a state where a handle cover is located at a first position.

As shown in FIG. 13, in the third embodiment, a handle cover 51 is provided at the drum cartridge 3.

6.1 Drum Cartridge 3

The drum cartridge 3 in the third embodiment includes the handle cover 51, a tube 52, a shaft 53, and a tension spring 54.

The handle cover 51 covers the photosensitive drum 12 in a state where the drum cartridge 3 is removed from the apparatus main body 2. In a state where the drum cartridge 3 is removed from the apparatus main body 2, the handle cover 51 is located at a first position relative to the photosensitive drum 12. As shown in FIG. 14, in a state where the drum cartridge 3 is installed in the apparatus main body 2 and where the developing cartridge 4 is removed from the apparatus main body 2, the handle cover 51 exposes the photosensitive drum 12 and exposes the first handle 16. In a state where the drum cartridge 3 is installed in the apparatus main body 2 and where the developing cartridge 4 is removed from the apparatus main body 2, the handle cover 51 is located at a second position relative to the photosensitive drum 12. As shown in FIG. 15, in a state where the drum cartridge 3 and the developing cartridge 4 are installed in the apparatus main body 2, the handle cover 51 exposes the photosensitive drum 12 and covers the first handle 16. In a state where the drum cartridge 3 and the developing cartridge 4 are installed in the apparatus main body 2, the handle cover 51 is located at a third position relative to the photosensitive drum 12. In the example shown in FIG. 15, the handle cover 51 covers a part of the first handle 16. The handle cover 51 may cover a part of the first handle 16, or may cover an entirety of the first handle 16.

Specifically, as shown in FIG. 13, the handle cover 51 has a boss 55. The handle cover 51 includes a first cover part 51A and a second cover part 51B. The second cover part 51B is rotatably attached to the first cover part 51A. The second cover part 51B is configured to rotatably move relative to the first cover part 51A about the boss 55. When the drum cartridge 3 is installed into the apparatus main body 2, the boss 55 contacts an arm 56 (see FIG. 14) of the apparatus main body 2. The arm 56 will be described later. As shown in FIG. 14, when the drum cartridge 3 is installed into the apparatus main body 2 in a state where the developing cartridge 4 is removed from the apparatus main body 2, the boss 55 contacts the arm 56 and thereby the handle cover 51 moves from the first position to the second position relative to the photosensitive drum 12. As shown in FIG. 15, when the developing cartridge 4 is installed into the apparatus main body 2 in a state where the drum cartridge 3 is installed in the apparatus main body 2, the boss 55 is pressed by the arm 56 and thereby the handle cover 51 moves from the second position to the third position relative to the photosensitive drum 12.

As shown in FIG. 13, the tube 52 accommodates the shaft 53 and the tension spring 54. The tube 52 is attached to the drum frame 15. The tube 52 is configured to rotatably move relative to the drum frame 15. Specifically, the tube 52 extends in a direction intersecting the axial direction. Preferably, the tube 52 extends in a direction perpendicular to the axial direction. The tube 52 has one end and an other end. The one end of the tube 52 is rotatably attached to the drum frame 15. The one end of the tube 52 is located closer to the photosensitive drum 12 than the first handle 16 is. The tube 52 has an opening 52A. The opening 52A is located at the other end of the tube 52.

The shaft 53 is coupled to the handle cover 51. The shaft 53 is accommodated inside the tube 52. The shaft 53 extends in the direction in which the tube 52 extends. The shaft 53 is configured to slide relative to the tube 52 in the direction in which the tube 52 extends. The shaft 53 has one end and an other end. The one end of the shaft 53 is accommodated inside the tube 52. The other end of the shaft 53 protrudes to outside the tube 52 through the opening 52A and is coupled to the handle cover 51.

The tension spring 54 is attached to inside the tube 52. The tension spring 54 is coupled to the one end of the shaft 53. When the shaft 53 slides relative to the tube 52 in the direction in which the shaft 53 protrudes from the tube 52, the tension spring 54 deforms and pulls the shaft 53 toward inside the tube 52 due to elastic force generated due to the deformation.

6.2 Apparatus Main Body 2

Figure 14:
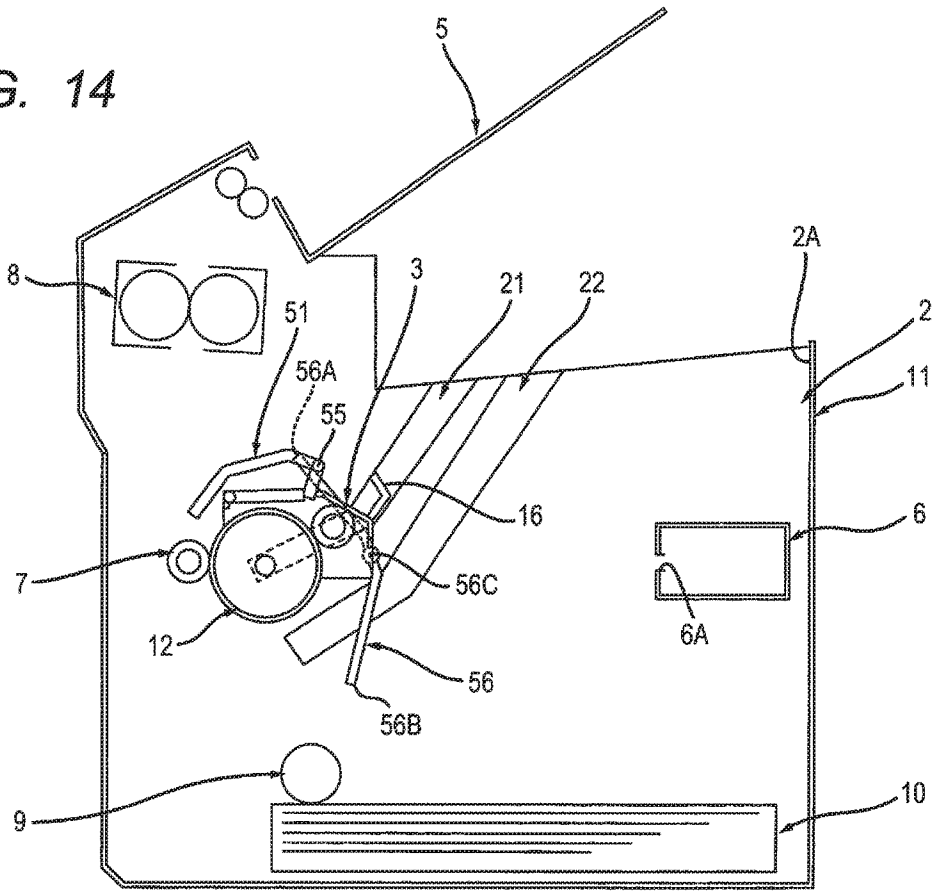
FIG. 14 is an explanatory diagram for illustrating an image forming apparatus according to the third embodiment, and shows a state where a developing cartridge is removed from an apparatus main body and where the handle cover is located at a second position.
Figure 15:
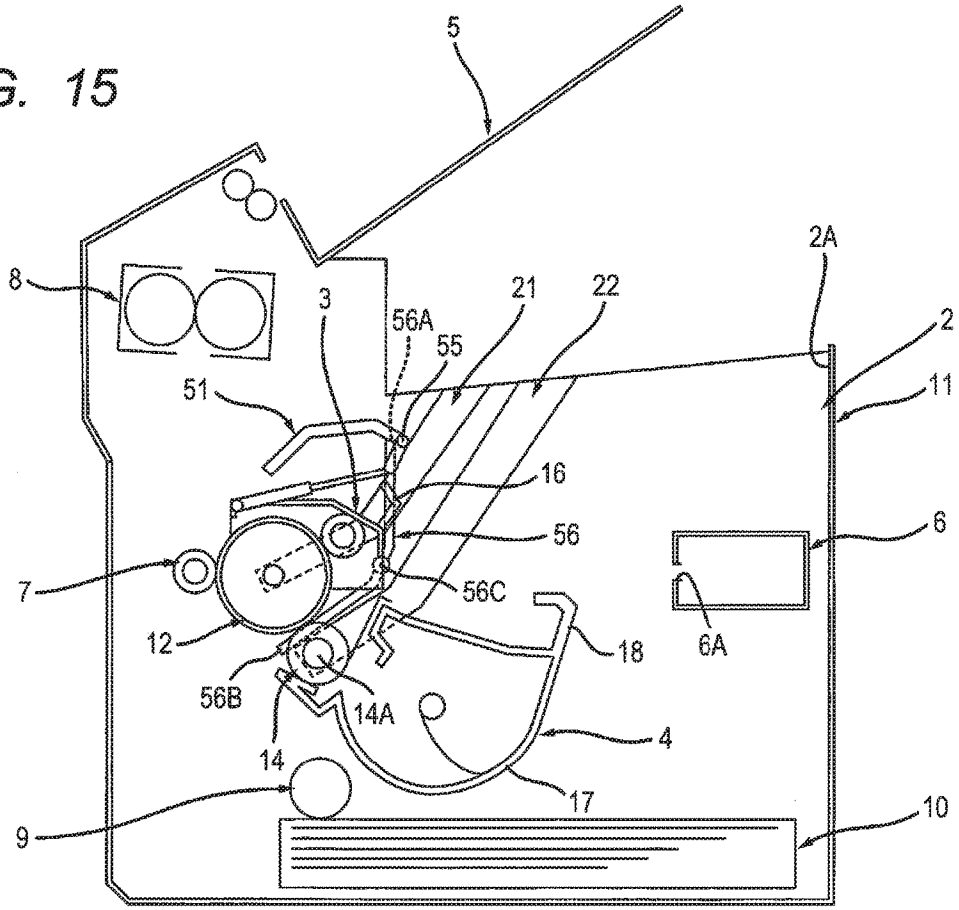
FIG. 15 is an explanatory diagram for illustrating the image forming apparatus according to the third embodiment, together with FIG. 14, and shows a state where the developing cartridge is installed in the apparatus main body and where the handle cover is located at a third position.

As shown in FIG. 14 and FIG. 15, the apparatus main body 2 of the third embodiment further includes the arm 56.

The arm 56 is configured to rotatably move relative to the apparatus main body 2. When the developing cartridge 4 is installed into the apparatus main body 2 in a state where the drum cartridge 3 is installed in the apparatus main body 2, the arm 56 rotatably moves due to contact with the developing cartridge 4, thereby moving the handle cover 51 from the second position to the third position. Specifically, the arm 56 is attached to the inner surface of the apparatus main body 2 in the axial direction. In a state where the drum cartridge 3 is installed in the apparatus main body 2, the arm 56 is located between the drum cartridge 3 and the inner surface of the apparatus main body 2 in the axial direction. The arm 56 extends in a direction intersecting the axial direction. Preferably, the arm 56 extends in a direction perpendicular to the axial direction. The arm 56 has one end 56A and an other end 56B in the direction in which the arm 56 extends. A rotational axis 56C of the arm 56 is located between the one end 56A and the other end 56B in the direction in which the arm 56 extends. As shown in FIG. 14, when the drum cartridge 3 is installed into the apparatus main body 2 in a state where the developing cartridge 4 is removed from the apparatus main body 2, the one end 56A of the arm 56 contacts the boss 55. With this configuration, the handle cover 51 moves from the first position to the second position relative to the photosensitive drum 12. As shown in FIG. 15, when the developing cartridge 4 is installed into the apparatus main body 2 in a state where the drum cartridge 3 is installed in the apparatus main body 2, the other end 56B of the arm 56 contacts the shaft 14A of the developing roller 14. With this configuration, the arm 56 rotatably moves relative to the apparatus main body 2. Then, the boss 55 is pressed by the one end 56A of the arm 56, and the handle cover 51 moves from the second position to the third position relative to the photosensitive drum 12.

In the third embodiment, operations and effects similar to those in the above-described first embodiment are obtained.

7. Modification of Third Embodiment

Figure 17:
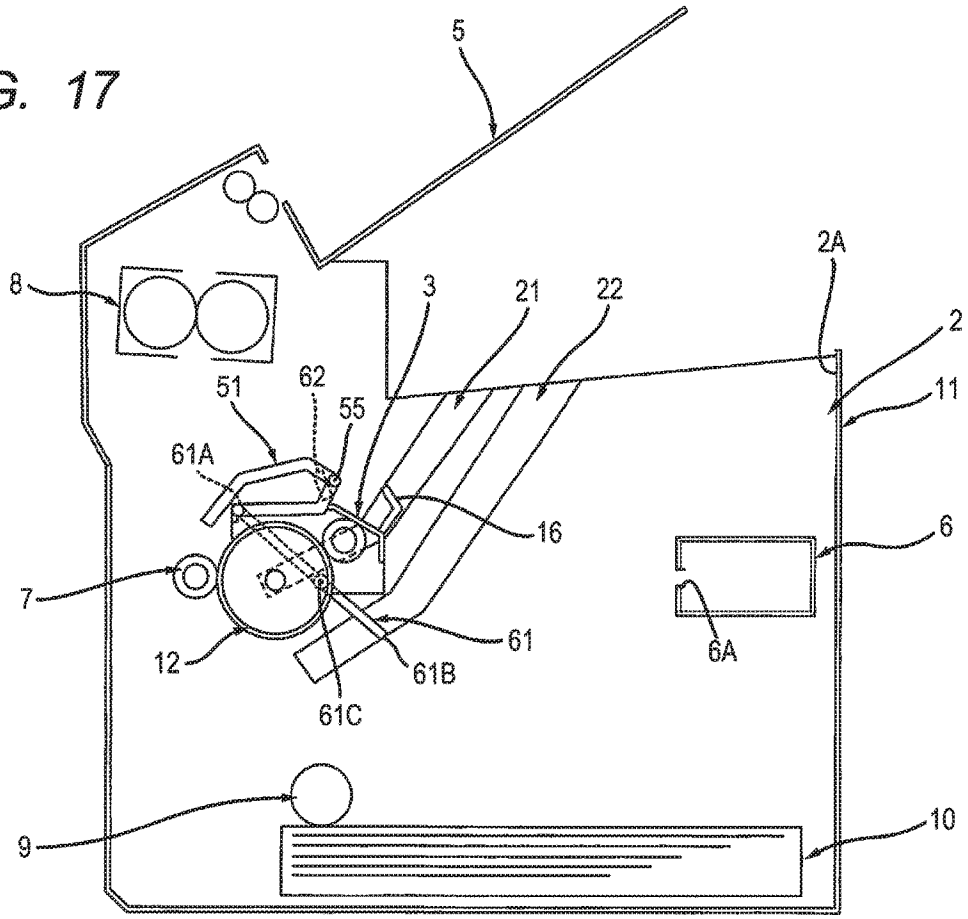
FIG. 17 is an explanatory diagram for illustrating an image forming apparatus according to the modification of the third embodiment, and shows a state where a developing cartridge is removed from an apparatus main body and where the handle cover is located at a second position.
Figure 18:
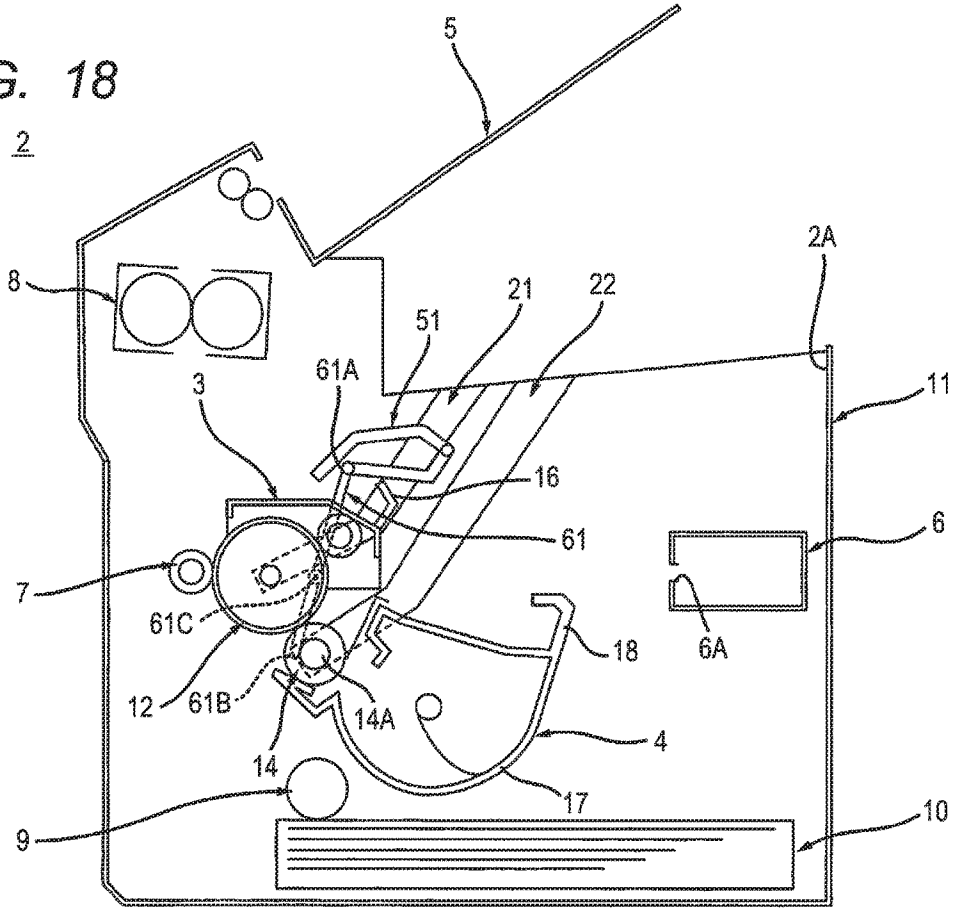
FIG. 18 is an explanatory diagram for illustrating the image forming apparatus according to the modification of the third embodiment, together with FIG. 17, and shows a state where the developing cartridge is installed in the apparatus main body and where the handle cover is located at a third position.

A modification of the third embodiment will be described while referring to FIG. 16 to FIG. 18. In the modification of the third embodiment, parts and components similar to those in the third embodiment are designated by the same reference numerals to avoid duplicating description.

Figure 16:
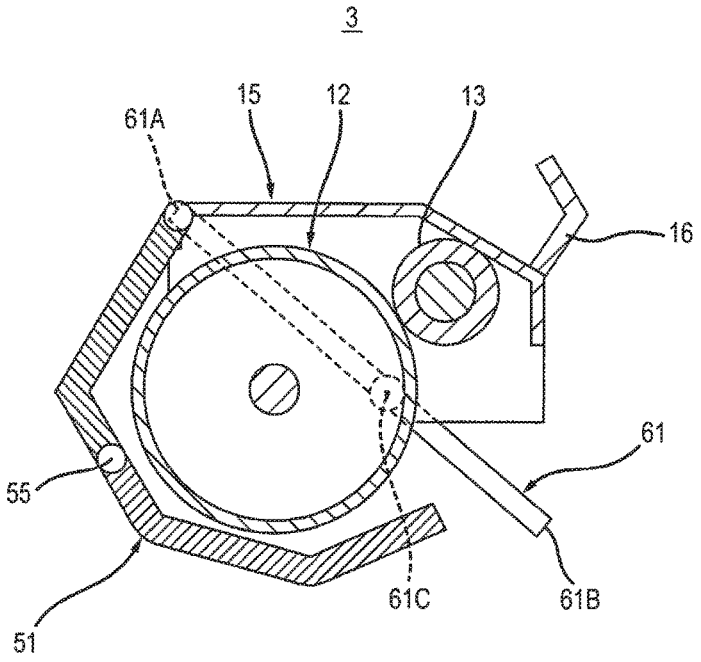
FIG. 16 is a cross-sectional view for illustrating a drum cartridge according to a modification of the third embodiment, and shows a state where a handle cover is located at a first position.

As shown in FIG. 16, an arm 61 may be provided at the drum cartridge 3. In this case, the arm 61 is configured to rotatably move relative to the drum cartridge 3. Specifically, the arm 61 is attached to the drum frame 15. In a state where the drum cartridge 3 is installed in the apparatus main body 2, the arm 61 is located between the drum frame 15 and the inner surface of the apparatus main body 2 in the axial direction. The arm 61 extends in a direction intersecting the axial direction. Preferably, the arm 61 extends in a direction perpendicular to the axial direction. The arm 61 has one end 61A and an other end 61B in the direction in which the arm 61 extends. The one end 61A is coupled to the handle cover 51. A rotational axis 61C of the arm 61 is located between the one end 61A and the other end 61B in the direction in which the arm 61 extends. As shown in FIG. 17, when the drum cartridge 3 is installed into the apparatus main body 2 in a state where the developing cartridge 4 is removed from the apparatus main body 2, the boss 55 contacts a rib 62 inside the apparatus main body 2 and thereby the handle cover 51 moves from the first position to the second position relative to the photosensitive drum 12. As shown in FIG. 18, when the developing cartridge 4 is installed into the apparatus main body 2 in a state where the drum cartridge 3 is installed in the apparatus main body 2, the other end 61B of the arm 61 contacts the shaft 14A of the developing roller 14. With this configuration, the arm 61 rotatably moves relative to the drum cartridge 3. At this time, the handle cover 51 moves from the second position to the third position relative to the photosensitive drum 12.

In the modification of the third embodiment, operations and effects similar to those in the above-described first embodiment are obtained.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

an apparatus main body formed with an opening, the apparatus main body including a cover configured to move between an open position at which the opening is opened and a closed position at which the opening is closed;

a drum cartridge including a photosensitive drum and configured to be installed into the apparatus main body;

a developing cartridge including a developing roller, the developing cartridge being configured to be installed into the apparatus main body independently from the drum cartridge; and a handle cover provided at the developing cartridge, the apparatus main body comprising:

a drum guide configured to guide installation of the drum cartridge into the apparatus main body, the drum guide extending in an installation direction of the drum cartridge, the drum guide having a first upstream end and a first downstream end in the installation direction of the drum cartridge; and a developing guide configured to guide installation of the developing cartridge into the apparatus main body, the developing guide extending in an installation direction of the developing cartridge, the developing guide having a second upstream end and a second downstream end in the installation direction of the developing cartridge, the second downstream end being located farther away from the opening than the first downstream end is, the drum cartridge including a first handle located inside the apparatus main body in a state where the drum cartridge is installed in the apparatus main body, the developing cartridge including a second handle located inside the apparatus main body in a state where the developing cartridge is installed in the apparatus main body, and the handle cover being located between the opening and the first handle so as to cover the first handle, in a state where the drum cartridge and the developing cartridge are installed in the apparatus main body, wherein the handle cover is configured to move relative to the developing roller between a first position at which the handle cover covers the developing roller and a second position at which the handle cover exposes the developing roller, wherein the handle cover is located at the first position in a state where the developing cartridge is removed from the apparatus main body, wherein the handle cover is located at the second position and covers the first handle in a state where the developing cartridge is installed in the apparatus main body, and wherein the apparatus main body further includes a handle guide configured to cause the handle cover to move from the first position toward the second position when the developing cartridge is installed into the apparatus main body.

2. The image forming apparatus according to claim 1, wherein the handle cover is spaced from the first handle in a state where the handle cover covers the first handle.

3. The image forming apparatus according to claim 1, wherein the handle guide is located between the drum cartridge and the opening in a state where the drum cartridge is installed in the apparatus main body, and wherein the handle guide includes:

a first part extending in a direction separating from the developing guide as the first part approaches the drum cartridge in a state where the drum cartridge is installed in the apparatus main body; and a second part continuing from the first part, the second part extending in a direction approaching the developing guide.

4. The image forming apparatus according to claim 3, wherein the handle cover is rotatably attached to the developing cartridge;

wherein the developing cartridge includes a boss protruding from the handle cover in an axial direction of the developing roller; and wherein, when the developing cartridge is installed into the apparatus main body, the boss is fitted in the handle guide, and the handle guide guides the boss thereby causing the handle cover to move from the first position toward the second position.

5. The image forming apparatus according to claim 1, further comprising an exposing device configured to expose the photosensitive drum, wherein the developing cartridge includes:

a developing frame supporting the developing roller;

a first arm coupled to the developing frame and to the handle cover; and a second arm spaced from the first arm in an axial direction in which a rotational axis of the photosensitive drum extends, the second arm being coupled to the developing frame and to the handle cover, wherein the handle cover is spaced from the developing frame in a state where the handle cover is located at the second position, and wherein the exposing device is formed with an emission opening for emitting light that passes between the first arm and the second arm and between the handle cover and the developing frame and that is incident on the photosensitive drum.

6. An image forming apparatus comprising:

an apparatus main body formed with an opening, the apparatus main body including a cover configured to move between an open position at which the opening is opened and a closed position at which the opening is closed;

a drum cartridge including a photosensitive drum and configured to be installed into the apparatus main body;

a developing cartridge including a developing roller, the developing cartridge being configured to be installed into the apparatus main body independently from the drum cartridge; and a handle cover provided at the apparatus main body, the apparatus main body comprising:

a drum guide configured to guide installation of the drum cartridge into the apparatus main body, the drum guide extending in an installation direction of the drum cartridge, the drum guide having a first upstream end and a first downstream end in the installation direction of the drum cartridge; and a developing guide configured to guide installation of the developing cartridge into the apparatus main body, the developing guide extending in an installation direction of the developing cartridge, the developing guide having a second upstream end and a second downstream end in the installation direction of the developing cartridge, the second downstream end being located farther away from the opening than the first downstream end is, the drum cartridge including a first handle located inside the apparatus main body in a state where the drum cartridge is installed in the apparatus main body, the developing cartridge including a second handle located inside the apparatus main body in a state where the developing cartridge is installed in the apparatus main body, and the handle cover being located between the opening and the first handle so as to cover the first handle, in a state where the drum cartridge and the developing cartridge are installed in the apparatus main body.

7. The image forming apparatus according to claim 6, wherein the apparatus main body further comprises an arm configured to support the handle cover, the arm being configured to rotatably move relative to the apparatus main body; and wherein, when the developing cartridge is installed into the apparatus main body in a state where the drum cartridge is installed in the apparatus main body, the developing cartridge contacts the arm and thereby moves the handle cover from a first position at which the handle cover exposes the first handle to a second position at which the handle cover covers the first handle.

8. An image forming apparatus comprising:

an apparatus main body formed with an opening, the apparatus main body including a cover configured to move between an open position at which the opening is opened and a closed position at which the opening is closed;

a drum cartridge including a photosensitive drum and configured to be installed into the apparatus main body;

a developing cartridge including a developing roller, the developing cartridge being configured to be installed into the apparatus main body independently from the drum cartridge; and a handle cover provided at the drum cartridge, the apparatus main body comprising:

a drum guide configured to guide installation of the drum cartridge into the apparatus main body, the drum guide extending in an installation direction of the drum cartridge, the drum guide having a first upstream end and a first downstream end in the installation direction of the drum cartridge; and a developing guide configured to guide installation of the developing cartridge into the apparatus main body, the developing guide extending in an installation direction of the developing cartridge, the developing guide having a second upstream end and a second downstream end in the installation direction of the developing cartridge, the second downstream end being located farther away from the opening than the first downstream end is, the drum cartridge including a first handle located inside the apparatus main body in a state where the drum cartridge is installed in the apparatus main body, the developing cartridge including a second handle located inside the apparatus main body in a state where the developing cartridge is installed in the apparatus main body, and the handle cover being located between the opening and the first handle so as to cover the first handle, in a state where the drum cartridge and the developing cartridge are installed in the apparatus main body.

9. The image forming apparatus according to claim 8, wherein the handle cover is configured to be located at:

a first position at which the handle cover covers the photosensitive drum, in a state where the drum cartridge is removed from the apparatus main body;

a second position at which the handle cover exposes the photosensitive drum and the handle cover exposes the first handle, in a state where the drum cartridge is installed in the apparatus main body and where the developing cartridge is removed from the apparatus main body; and a third position at which the handle cover exposes the photosensitive drum and the handle cover covers the first handle, in a state where the drum cartridge and the developing cartridge are installed in the apparatus main body.

10. The image forming apparatus according to claim 9, wherein the apparatus main body further comprises an arm configured to rotatably move relative to the apparatus main body, the arm being configured to contact the developing cartridge and thereby rotatably move so as to move the handle cover from the second position to the third position when the developing cartridge is installed into the apparatus main body in a state where the drum cartridge is installed in the apparatus main body.

11. The image forming apparatus according to claim 9, wherein the drum cartridge further comprises an arm configured to rotatably move relative to the drum cartridge, the arm being configured to contact the developing cartridge and thereby rotatably move so as to move the handle cover from the second position to the third position when the developing cartridge is installed into the apparatus main body in a state where the drum cartridge is installed in the apparatus main body.

* * * * *